US005738620A

United States Patent [19]

Ebner et al.

[11] Patent Number: 5,738,620

[45] Date of Patent: Apr. 14, 1998

[54] DEVICE FOR FOLDING SHEETS

[75] Inventors: Arno Ebner, Ammerbuch; Juregen Ries, Ostfildern, both of Germany

[73] Assignee: Eastman Kodak Company, Rochester, N.Y.

[21] Appl. No.: 749,255

[22] Filed: Nov. 15, 1996

[30] Foreign Application Priority Data

Nov. 18, 1995 [DE] Germany ..... 195 43 152.9

[51] Int. Cl.[6] ..... B65H 45/16

[52] U.S. Cl. ..... 493/445

[58] Field of Search ..... 493/494, 445, 493/446

[56] References Cited

U.S. PATENT DOCUMENTS 907,122 12/1908 Bray ..... 493/445
941,747 11/1909 Wallace ..... 493/444
5,169,376 12/1992 Ries ..... 493/445

*Primary Examiner*—Jack W. Lavinder

*Attorney, Agent, or Firm*—Lawrence P. Kessler

[57] ABSTRACT

Pre-folding rollers and pinch rollers (1, 2 3, and 4) of identical diameter are arranged one behind the other in the folding direction (A) and rotatably mounted between two plates (5). A second pre-folding roller (2) and a second pinch roller (4) are stationarily and rotatably mounted on the plate (5). The first pre-folding roller (1) is rotatably mounted at both its ends with its bearings (1a) on lever arms (6) pivotably arranged on the plates (5). Connecting arms (7) are linked to the bearings (1a), on which arms the second pinch roller (3) is rotatably mounted on bearings (3a). The connecting arms (7) are loaded by springs (13) transverse to a folding direction and are in contact with fixed stops (8a and 10 respectively). The stops (8a and 10) are so positioned that the pre-folding and pinch rollers (1, 2 3, and 4) do not touch, so that the bearings (1a, 2a, 3a, and 4a respectively) are not subjected to load while no folding is in progress. The folded product emerging the pre-folding rollers (1 and 2) lifts the connecting arms (7) from the stops (10) and sets by this pivoting movement a gap s' dependent on the product thickness at the pinch rollers (3 and 4), which facilitates gripping of the product.

3 Claims, 2 Drawing Sheets

DEVICE FOR FOLDING SHEETS

BACKGROUND OF THE INVENTION

The invention relates to a device for folding of at least one sheet, with driveable pre-folding rollers and pinch rollers arranged parallel and in pairs and one behind the other in the folding direction and rotatably mounted, in which a first pre-folding roller and a first pinch roller are mounted on connecting arms pivotably linked to the bearing of the first pre-folding roller and spring-loaded vertically to the folding direction, and in which the bearing of the first pre-folding roller is rotatably arranged at one end of lever arms whose other ends are pivotably and stationarily linked in the folding direction behind the first pinch roller, with the device having a folding knife pushing the sheet between the pre-folding rollers by a roof-like formation in the folding area.

In a known device of this type (DE-OS 41 09 399), a sheet to be folded is moved by a folding knife between a pair of pre-folding rollers that convey the pre-folded sheet to a pair of pinch rollers that complete the folding operation. If no folding operation takes place, the folding roller pairs of this device are in contact with one another under spring pre-tension such that there is a high bearing load at all times. During opening of the pre-folding rollers or pinch rollers by the folded product, their pre-tension is increased in each case such that the folding operation is performed by the pinch rollers in the required form with increased contact pressure.

If a sheet stack comprising several sheets is to be folded at the same time, the following pinch rollers of the known device, which must be spring-loaded against one another in order to compensate for the thickness, meet the pre-folded sheet stack with a considerable resistance, leading to damage of the sheets and function faults.

SUMMARY OF THE INVENTION

The object of the present invention is to create a device that, whenever no folding operation is to be carried out, the strain on the bearings is reduced and in addition the folding of single sheets or of a sheet stack can be performed without faults.

This object is achieved in accordance with the invention in that

- a second pre-folding roller and a second pinch roller are stationarily and rotatably mounted,
- the connecting arms arranged between the first pre-folding roller and the first pinch roller can with their two end zones contact stationary stops by the effect of their spring loading, said stops being positioned such that the opposite pre-folding roller or pinch roller pairs do not touch, and
- the one stop is arranged in the folding direction behind the bearing of the first pinch roller and the other stop in the entry area of the pre-folding rollers, such that a pivoting movement of the first pre-folding roller about the stationary bearing causes a forced pivoting movement of the first pinch roller in the same direction, said movement setting a roller gap at the pinch roller.

By the embodiment in accordance with the invention, it is advantageously achieved that when no folding operation is performed, there is also no spring loading of the bearings, since in this operating state the spring pre-tension is taken up by the stops for the connecting arms and the folding rollers do not touch. On the one hand this prevents unnecessary wear on the bearings when no folding operation takes place and on the other hand permits a considerable increase in the spring force for the folding roller contact pressure when a folding operation does take place, hence improving the folding quality.

Since the connecting arms between the first pre-folding roller and the first pinch roller contact a stop arranged in the folding direction behind the first pinch roller, a pivoting movement of the first pinch roller that forms a roller gap at the pinch roller is achieved in an advantageous manner when the first pre-folding roller is pivoted by the incoming folding product. As a result, it is achieved in particularly advantageous manner that in particular a pre-folded sheet stack comprising several sheets can be pushed more easily by the pre-folding rollers into the pinch rollers, so that the sheets are not damaged and function faults are avoided.

In advantageous embodiment of the invention, the spring loading of the first pre-folding roller and of the first pinch roller is in an area closer to the pinch roller pair, so that the greater part of the spring force acts on the pinch roller pair, thereby achieving a further improvement in the folding quality.

By the embodiment of the folding device in accordance with the invention, it is furthermore advantageously achieved that the contact force of the first pre-folding roller is increased as soon as a pre-folded sheet stack passes between the pinch roller. As a result, the sheets are pressed so strongly together that they cannot slip in relation to one another when they are pushed between the pinch rollers, thereby achieving a more dependable folding operation.

By this advantageous embodiment of the invention, it is possible by pivoting the lever arms to jointly raises the first pre-folding roller and the first pinch roller far enough to permit easy rectification of any function fault.

BRIEF DESCRIPTION OF THE DRAWINGS

Further advantages and features of the invention are given in the description of an example of the invention shown in the drawing and in the claims. The drawing show, in diagram form, in FIG. 1 a side view of the device in a simplified view, and FIG. 2 a partial view of the device according to FIG. 1 seen in the direction "B".

DETAILED DESCRIPTION OF THE INVENTION

Figure 1:
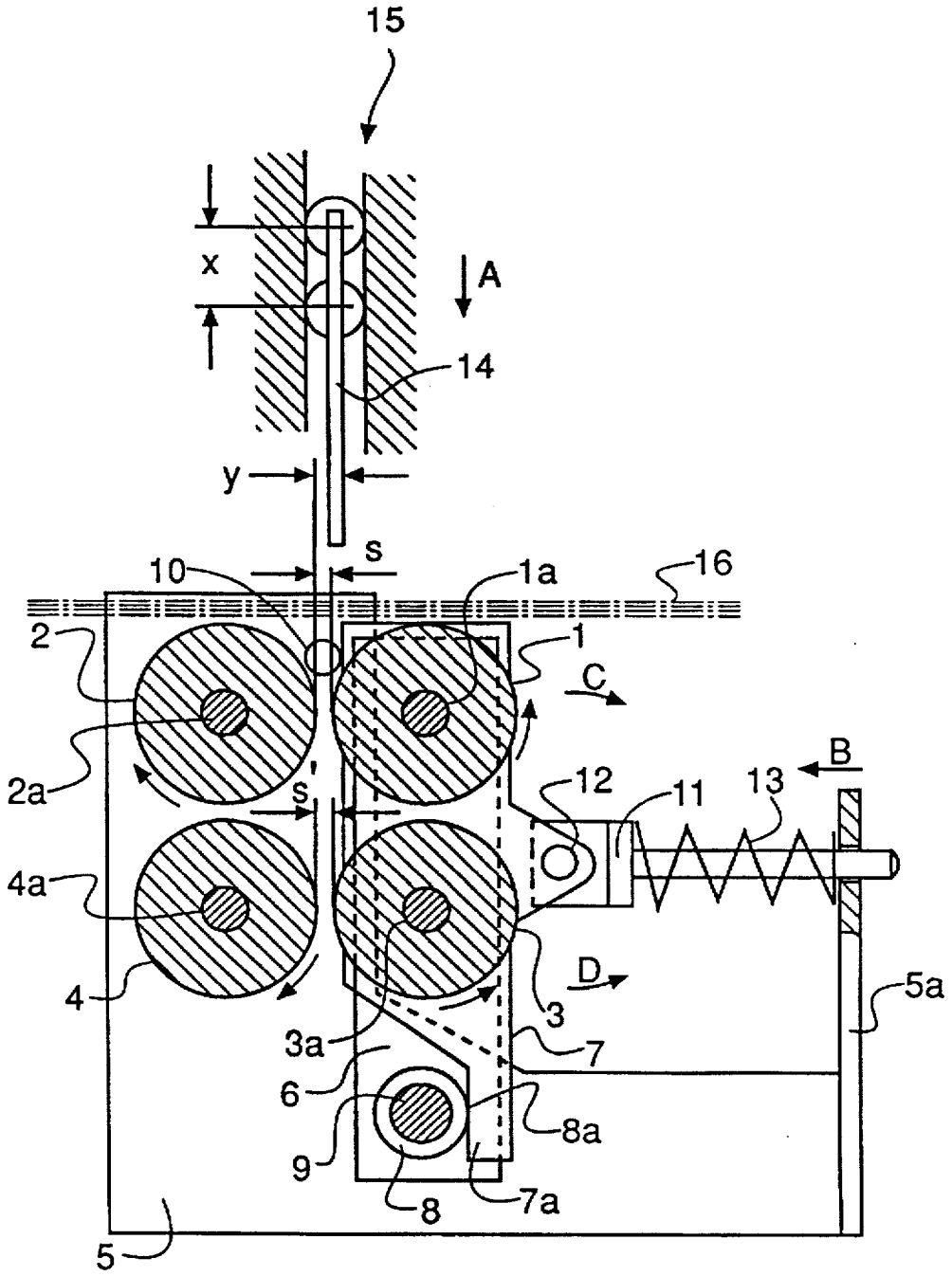

The device in accordance with the invention for folding sheets is arranged on a further processing device, not shown, of known type in which individually supplied sheets, in particular copy sheets output by a copier, are collected in a connecting station to form a stack. The drawing shows only those parts of the further processing device connected to a copier, not shown, that are necessary for understanding the invention.

The further processing device can have a stapling device, not shown, of known design, in which the sheets are first collected, stapled and then moved to the folding position shown in FIG. 1. The folding device has in accordance with FIG. 1 pre-folding rollers 1, 2 and pinch roller 3, 4 of identical diameter arranged parallel and in pairs, and rotatably mounted by their ends in bearings 1*a*, 2*a* and 3*a*, 4*a* and between two parallel plates 5 rigidly mounted inside the further processing device in a manner not shown.

The pre-folding rollers and pinch rollers 1, 2, and 3, 4 are jointly rotated in the folding direction "A" via a drive shaft 9 and a belt and chain mechanism, not shown, by a drive motor, not shown. The second pre-folding roller 2 and the second pinch roller 4 with their bearing 2*a* and 4*a* respectively are rotatably mounted on the plates 5 stationarily.

The first pre-folding roller 1 is rotatably mounted at both ends with its bearings 1*a* at the free ends 6*a* of bearing arms 6. The lever arms 6 are pivotably linked at their other ends with bearing bushes 8 fastened to the plates 5. The bearing bushes 8 double as pivot bearings for the drive shaft 9 and as a stop 8*a* for connecting arms 7, 7*a*, with the outer diameter of the bearing bushes 8 acting as the stop 8*a*, so that the pivot bearing of the drive shaft 9 is not strained by the connecting arms 7, 7*a*.

Figure 2:
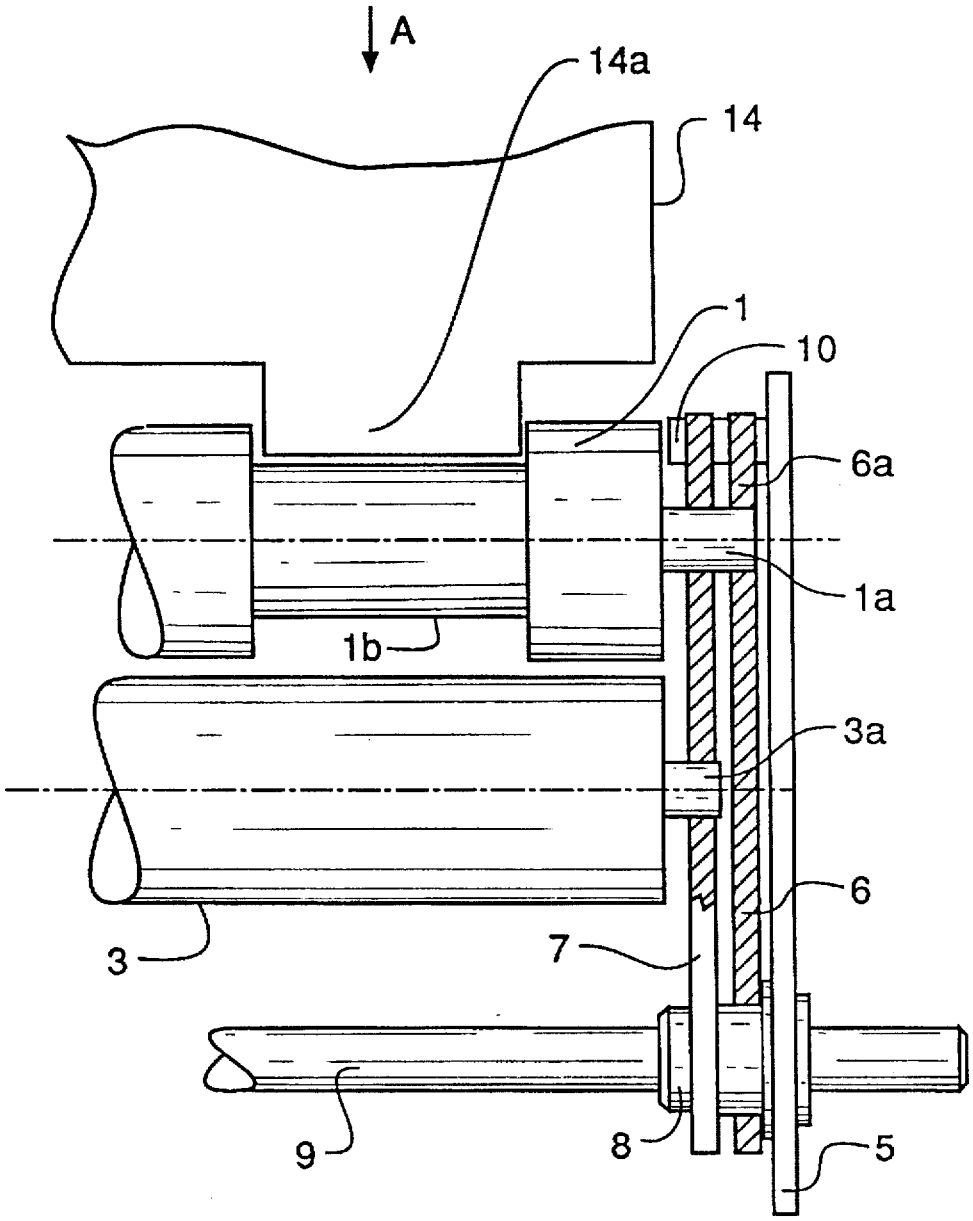

The two ends of the first pre-folding roller 1 each have a connecting arm 7 linked (see FIG. 2) to their bearings 1*a*, to the other ends of which arms the first pinch roller 3 is rotatably mounting on bearings 3*a*. The connecting arms 7 are spring-loaded by springs 13 (see FIG. 1) that act on the first pre-folding roller 1 and the first pinch roller 3 in the arrow direction "B". The springs 13 are mounted on holders 11, to the one end of which the connecting arms 7 are pivotably linked by bearings 12, while the other end of the holder 11 is guided in a section 5*a* of the plate 5. The connecting arms 7 and the lever arms 6 are arranged parallel to the folding direction "A".

Above the pre-folding roller 1 and 2 a folding knife 14 of known type and insertable between said rollers in the folding direction "A" is arranged that is movable back and forth in the fold direction "A" by a drive device, not shown (for example in accordance with DE-OS 01 399). The pre-folding rollers 1 and 2 are, in accordance with FIG. 2, each provided in known manner with small-diameter recesses 1*b* designed in some parts in annular form, into which recesses comb-like projections 14*a* of a folding knife 14 can engage in known manner. This design permits the sheets being folded to be pushed deeply between the pre-folding roller 1 and 2 without major effort, so that the sheets are dependably gripped. The folding device is equally suitable for folding a single sheet or several sheets collected in stack form, and in the latter case for stapled or unstapled sheet stacks 16.

In the starting position of the device as shown in FIG. 1, the connecting arms 7 are pressed by the springs 13 against stationary stops 8*a* and 10 attached to the plates 5, said stops being so positioned that the paired rollers 1, 2, and 3, 4 are spaced by a roller gap of, for example, 0.2 mm from one another (the gap clearance in FIG. 1 is shown enlarged for greater clarity) and hence do not touch. By this measure, the bearings 1*a*, 2*a* and 3*a*, 4*a* are not strained by the springs 13 in the initial position of the device and are hence protected from unnecessary wear.

The mode of operation of the device is as follows:

The sheet stack 16 to be folded is positioned at a stop, not shown, such that the intended fold is underneath the folding knife 14. Starting the drive device moves the folding knife 14 in the folding direction "A" and pushes the sheet stack 16 in the known manner between the pre-folding roller 1 and 2 while creating a roof-like formation.

The first pre-folding roller 1 is here pivoted in the arrow direction "C" about the stationary bearings 8 of the lever arms 6 until the pre-folded sheet stack is gripped by the driven pre-folding roller 1 are lifted from the stop 10 such that the contact pressure force of the springs 13 that are now further pre-tensioned during this pivoting movement can act fully on the first pre-folding roller 1. The thickness of the sheet stack inserted between the pre-folding roller 1 and 2 sets the gap between the latter to a spacing s.

Depending on the pivoting movement of the lever arms 6 in the direction of the arrow "C", the first pinch roller 3 is also pivoted in the same direction and the folding gap s' is formed between the pinch rollers 3 is supported are still in contact at their free ends 7*a* with the stops 8*a*, so that the bearings 3*a* and 4*a* of the pinch rollers 3 and 4 are still not subjected to stress in this operating phase, but the entire force of the springs 13 can instead act on the first pre-folding roller 1. The folding gap s' is formed automatically depending on the folding gap s', meaning that the thicker the sheet stack entering the pre-folding rollers 1, 2, the wider the setting of the folding gap s' at the pinch rollers 3, 4, thereby permitting problem-free entry at the pinch roller 3 and 4.

The folding knife 14 is retracted again, after insertion of the sheet stack 16 and gripping by the pre-folding roller 1 and 2, by its drive device against the arrow direction "A". To permit the folding knife to enter centrally between the pre-folding rollers 1 and 2, although the second pre-folding roller 2 is stationarily mounted and therefore cannot be diverted vertically to the folding direction "A", its guide 15 is especially designed such that the folding knife 14 is arranged an amount y of, for example, 1 mm above the tangent of the pre-folding roller 2. In addition, its guide base x in relation to the knife length and the width of the guide slot (guide play) is designed such that together with the offset by the amount y, the folding knife 14 can perform an adjustment to the various sheet stack thicknesses in relation to the pre-folding roller gap.

Since the pre-folding rollers 1 and 2 act without any decrease in their contact pressure on the folded product being conveyed when the latter presses apart the pinch rollers 3 and 4 in order to open the folding gap, the product is kept and guided dependably in its orientation. The pre-folded sheet stack is conveyed by the pre-folding roller 1, 2 to the pinch roller 3, 4 and forces aside the second pinch roller 3 and hence the connecting arms 7 in the direction "D" with further tensioning of the springs, with the connecting arms 7 being lifted by their ends 7*a* from the stop 8*a*. The increase in the pre-tensioning of the springs 13 caused by the pivoting movement of the second pinch roller 3 presses the first pre-folding roller 1 against the second pre-folding roller 2 more firmly via the connecting arms 7, so that the product conveyed between them is conveyed with increased contact pressure. As a result, the guiding and pushing force on the pre-folded product is increased so that it is dependably conveyed without being able to avoid the pinch rollers 3, 4.

As FIG. 1 shows, the springs 13 engage in a point on the connecting arms closed to the pinch rollers 3 and 4, such that the greater part of the spring force is applied to the pinch roller pair 3 and 4, thereby achieving a better folding quality. The pinch rollers 3, 4 then complete the folding operation under an increased contact pressure of the tensioned springs 13 and convey the completed product into a storage container, not shown.

Once the product has passed the folding rollers 1, 2, 3, and 4 the connecting arms 7 again contact the stationary stops 8*a* and 10 under spring pressure. The device thus returns to its starting position, in which the rollers 1, 2, and 3, 4 do not touch, so that the bearings 1*a*, 2*a* and 3*a*, 4*a* respectively are not subject to any unnecessary wear.

Diverging from the embodiment shown according to FIG. 1, it is possible, by changing the point of application of the springs 13 in the direction of the first pinch roller or the first pre-folding roller, for example using a setting device, not shown, to set or alter the contact pressure of the first pre-folding roller 1 or the second pinch roller 3.

The present invention was described with reference to a preferred embodiment, but modifications can of course be made by one skilled in the art, without leaving the scope of the claims which follow.

We claim:

1. A device for folding of at least one sheet, with driveable pre-folding rollers and pinch rollers (1, 2, 3, and 4) arranged parallel and in pairs and located one behind another in a folding direction (A) and rotatably mounted, in which a first pre-folding roller (1) and a first pinch roller (3) are mounted on connecting arms (7) pivotably linked to a bearing (1*a*) of said first pre-folding roller (1) and spring-loaded (13) substantially transverse to said folding direction (A), and in which said bearing (1*a*) of said first pre-folding roller (1) is rotatably arranged at one end of lever arms (6) whose other ends are pivotably linked, in said folding direction (A), behind said first pinch roller (3) on a stationary bearing (8), with said device having a folding knife (14) pushing said sheet between said pre-folding rollers (1, 2) creating a roof-like formation in a folding area, characterized in that a second pre-folding roller (2) and a second pinch roller (4) are stationarily and rotatably mounted in said folding device, said connecting arms (7), arranged between said first pre-folding roller (1) and said first pinch roller (3), at their two ends, contact two stationary stops (8*a*, 10) respectively, due to such spring loading, said two stops being positioned such that opposed rollers of said pre-folding roller or pinch roller pairs (1, 2, 3, and 4) do not touch, and one of said two stationary stops (8*a*) is located, in said folding direction (A), behind the bearing (3*a*) of said first pinch roller (3) and the other of said two stationary stops (10) is located adjacent to an entry area of said pre-folding rollers (1, 2) such that pivoting movement (C) of said first pre-folding roller (1) about said stationary bearing (8) causes a forced pivoting movement of said first pinch roller in the same direction as pivoting movement (C) of said first pre-folding roller (1), said pivoting movement of said first pinch roller setting a roller gap (s') at said pinch rollers (3, 4).

2. A sheet folding device according to claim 1, characterized in that the spring loading of said connecting arms (7) is achieved by springs (13) in an area between said pre-folding roller (1) and said first pinch roller (3) closer to said first pinch roller (3).

3. A sheet folding device according to claim 2, characterized in that said one stop (8*a*) is formed by bearing bushes (8) that are fastened in parallel to stationary plates (5), in that the lever arms (6) are pivotably linked to said bearing bushes 8, and in that said bearing bushes (8) are used as pivot bearings for a drive shaft (9) driving said pre-folding and pinch rollers (1, 2, 3, and 4).

* * * * *